US006499230B1

(12) United States Patent
Fix

(10) Patent No.: US 6,499,230 B1
(45) Date of Patent: Dec. 31, 2002

(54) GOLF CLUB GRIP DEHUMDIFIER

(76) Inventor: Mark Eugene Fix, 1140 Brinton Ave., Pitcairn, PA (US) 15140

( * ) Notice: Subject to any disclaimer, the term of this patent is extended or adjusted under 35 U.S.C. 154(b) by 0 days.

(21) Appl. No.: 09/624,418

(22) Filed: Jul. 24, 2000

(51) Int. Cl.[7] ..... F26B 25/06

(52) U.S. Cl. ..... 34/223; 34/69; 34/90; 34/107; 34/202

(58) Field of Search ..... 34/69, 90, 107, 34/202, 218, 223, 224

(56) References Cited

U.S. PATENT DOCUMENTS 4,570,358 A * 2/1986 Sacerdote ..... 34/54
4,914,832 A * 4/1990 Cuthbert ..... 34/333
4,934,066 A * 6/1990 Rose ..... 34/333
5,918,254 A * 6/1999 Bottiger et al. ..... 73/1.06

* cited by examiner

*Primary Examiner*—Pamela Wilson
(74) *Attorney, Agent, or Firm*—H. Jay Spiegel

(57) ABSTRACT

A golf club grip drying device includes one chamber for receipt of a golf club grip and an adjacent chamber for receipt of an aerosol gas dispenser with a transfer tube conveying gas from the aerosol gas dispenser chamber to the golf club grip chamber. An actuator is provided which is responsive to movement of the golf club grip within its chamber so that when the golf club grip is so inserted, it engages the actuator which in turn engages the aerosol gas dispenser to open a valve contained within the aerosol gas dispenser and cause dispensing of aerosol gas within the golf club grip chamber to remove moisture from the surface of the golf club grip and therefore dry it.

20 Claims, 3 Drawing Sheets

GOLF CLUB GRIP DEHUMDIFIER

BACKGROUND OF THE INVENTION

The present invention relates to an ultra dry golf club grip dehumidifier system. Previously, golfers would utilize some sort of towel or other drying implement to dry golf club grips. It would be an improvement over such use of towels to provide a device in which a golf club grip could be placed completely within an enclosed chamber and dried using an aerosol dehumidifying gas. It is with this thought in mind that the present invention was developed.

In the prior art, it is known to dry the grip of a golf club to enhance the security of a golfer's grasp on the golf club grip. Applicant is aware of the following U.S. Patents:

U.S. Pat. No. 4,570,358 to Sacerdote

U.S. Pat. No. 4,914,832 to Cuthbert

U.S. Pat. No. 4,934,066 to Rose

U.S. Pat. No. 5,918,254 to Bottiger et al.

None of these references teaches or suggests the concept of drying the grip of a golf club by inserting the golf club grip within an enclosed chamber and wherein motion of the golf club grip into the chamber causes actuation of an aerosol dispenser to dispense an aerosol gas into the enclosed chamber to dehumidify and dry the golf club grip.

SUMMARY OF THE INVENTION

The present invention relates to an ultra dry golf club grip dehumidifier system. The present invention includes the following interrelated obpects aspects and features:

(1) In a first aspect, the present invention contemplates providing an enclosed chamber having an opening permitting a golf club grip to be inserted therethrough while maintaining a secure seal about the periphery of the golf club grip.

(2) Fluidly connected to the enclosed chamber is a chamber containing an aerosol gas dispenser. The aerosol gas dispenser is associated with a passageway designed to convey aerosol gas from the dispenser into the enclosed chamber where the golf club grip is to be inserted.

(3) An actuator is provided that engages the aerosol gas dispenser and the golf club grip as it is inserted within the enclosed chamber. As the golf club grip is inserted into the enclosed chamber, it engages the actuator which causes, in the preferred embodiment, the aerosol gas dispenser to be activated to release aerosol gas into the enclosed chamber to dry and dehumidify the golf club grip.

As such, it is a first object of the present invention to provide an ultra dry golf club grip dehumidifier system.

It is a further object of the present invention to provide such a device in which a golf club grip is inserted within an enclosed chamber.

It is a yet further object of the present invention to provide such a system wherein an aerosol gas dispenser is located in fluid connection with the enclosed chamber receiving the golf club grip.

It is a still further object of the present invention to provide such a system in which insertion of the golf club grip into the enclosed chamber causes actuation of a valve associated with the aerosol gas dispenser to open the aerosol gas dispenser and dispense aerosol gas into the enclosed chamber to dry the surface of the golf club grip.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
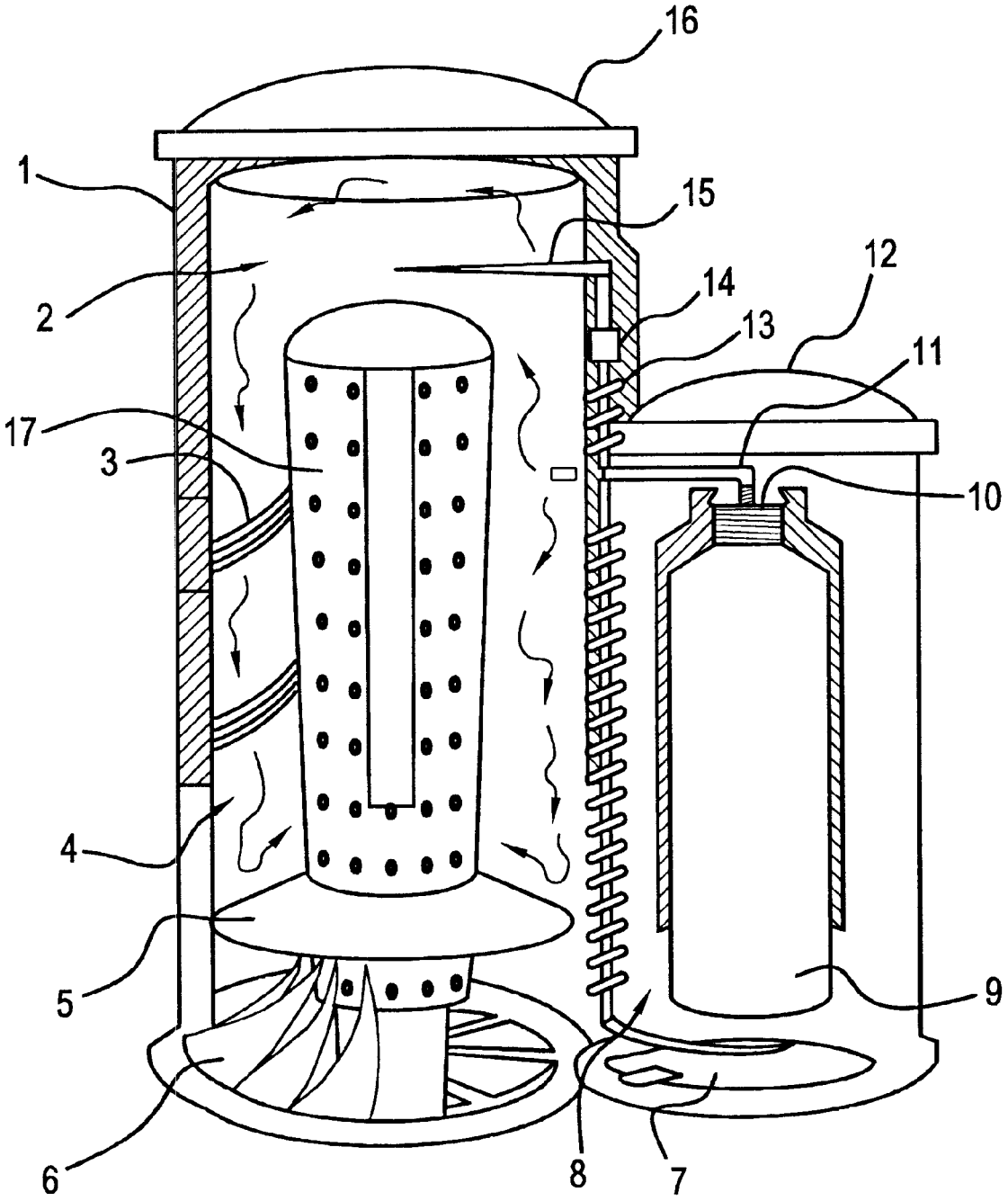
FIG. 1 shows a side view, partially in cross-section, of a preferred embodiment of the present invention.
Figure 2:
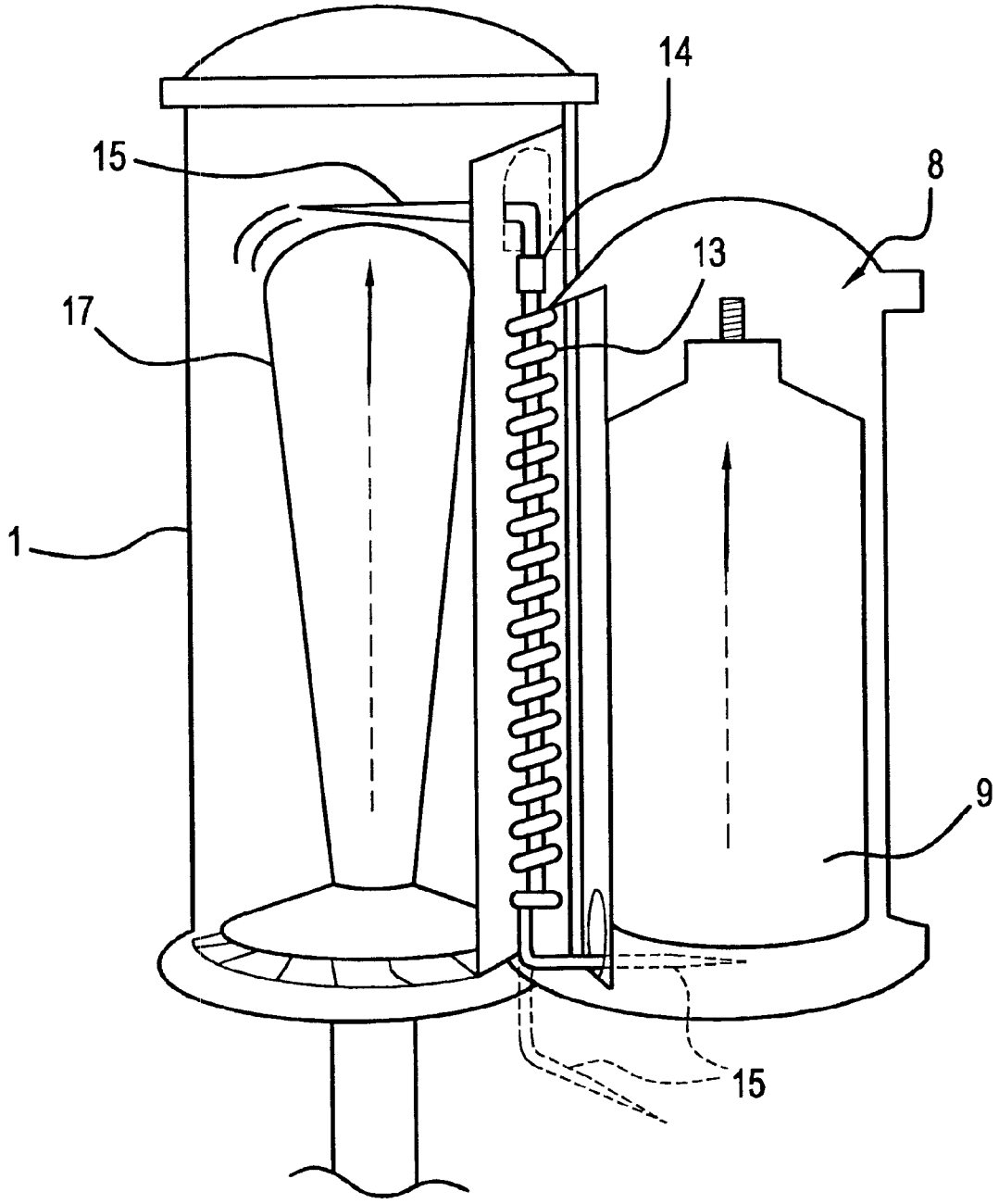
FIG. 2 shows a view similar to that of FIG. 1 but showing movement of a golf club grip and resultant movement of an aerosol gas dispenser to a position of actuation.
Figure 3:
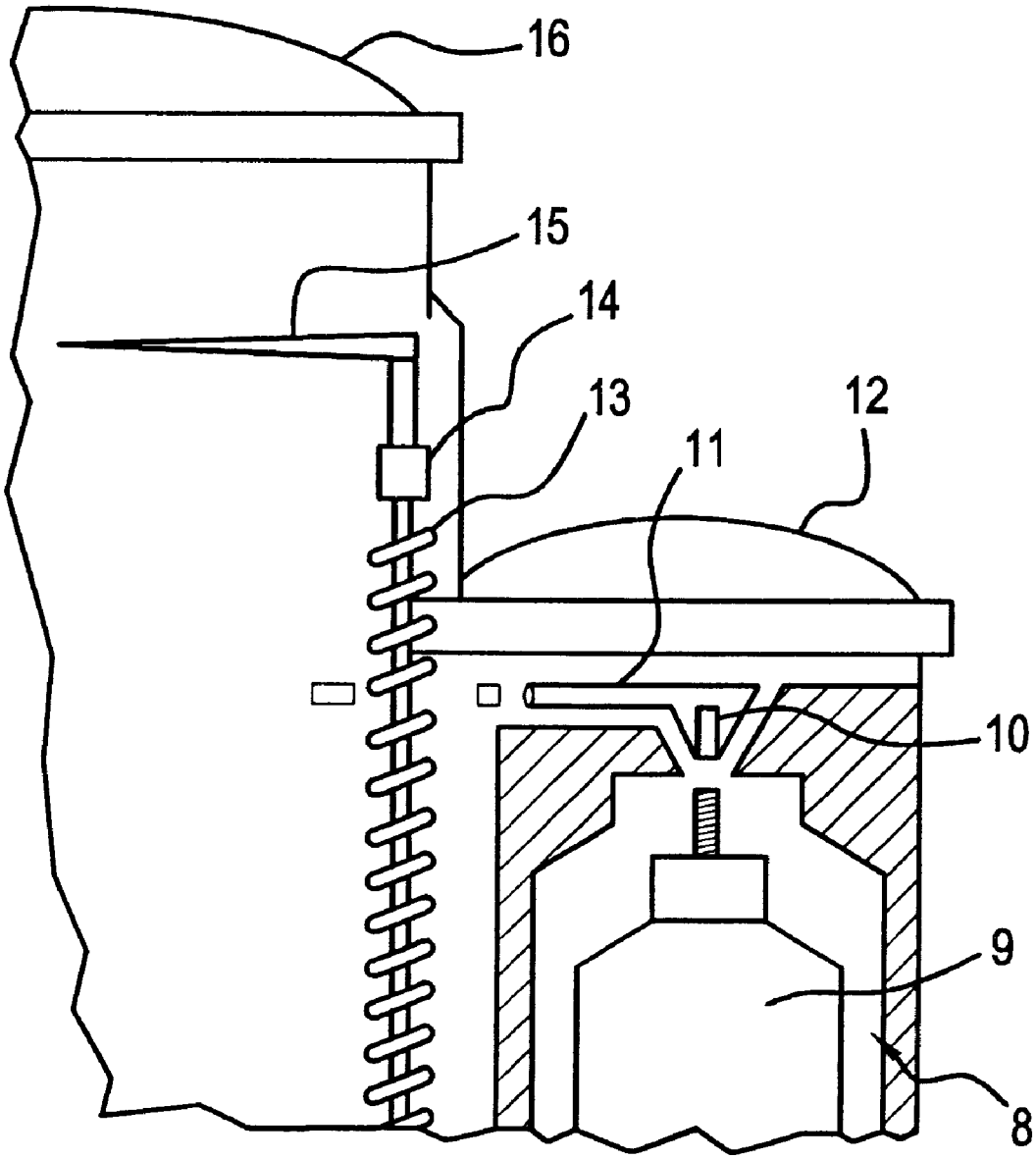
FIG. 3 shows an enlarged view, partially in cross-section, and partially exploded, showing the manner of interconnection of an aerosol gas dispenser to the inventive device.

With reference to FIGS. 1–3, the preferred embodiment of the present invention includes a generally cylindrical housing having an outer cylindrical wall 1 and an inner cylindrical wall 4 defining the periphery of a drying chamber 2. A plurality of brushes 3 are mounted within the chamber 2 and may be made of a material such as, for example, nylon. The chamber 2 is open at its bottom and is sealed by a rubber throat 6 having a plurality of slits as particularly shown in FIG. 1 to permit a golf club grip 17 to be inserted through the throat 6 and into the chamber 2. The golf club grip includes a rubber grommet 5 as well as a depending shaft (not shown in detail).

Adjacent the drying chamber 2, an aerosol chamber 8 is provided which contains a receptacle (best seen in FIG. 3) for receiving an aerosol gas dispenser 9 provided in its most common form, to wit, a can. The aerosol gas dispenser is quite conventional and includes a valve (not shown) which is activated when the hollow tube 21 is depressed in the downward direction in the view of FIGS. 1–3. The chamber 8 includes an opening closeable by a hinged door 7 having any suitable latching mechanism so that the door 7 may be opened, the aerosol gas dispenser 9 may be inserted within the chamber 8 with its threaded tube 21 threadably received within the fixed threaded nozzle 10, whereupon the door 7 may be closed to seal the chamber 8. As seen in particular in FIG. 3, a fixed threaded nozzle 10 is provided within the chamber 8 and the hollow tube 21 of the dispenser 9 is threadably received within the fixed threaded nozzle 10 to fix the position of the aerosol gas dispenser 9 therewithin. A transfer tube 11 is fluidly connected to the nozzle 10 and as best seen in FIG. 1 conveys gas from the aerosol gas dispenser into the drying chamber 2.

With reference to FIGS. 1 and 3 in particular, an activation rod 15 includes a horizontally disposed portion within the drying chamber 2, a horizontally disposed portion within the aerosol chamber 8, and a vertical portion at the intersection of the two chambers interconnecting the horizontal portions thereof for a purpose to be described in greater detail hereinafter. The rod 15 is surrounded by a spring 13 installed below a spring retainer 14. The spring 13 biases the rod 15 in the downward direction in the view of the figures.

In the operation of the present invention, referring to FIGS. 1–3, when it is desired to dry a golf club grip, the aerosol gas dispenser 9 is first installed onto the fixed threaded nozzle 10 in the manner described hereinabove. The door 7 is latched shut to close the chamber 8. A golf club grip 17 is inserted through the collapsible rubber throat 6 and advances in the upward direction in the view of FIG. 1. Looking at FIG. 2, when the top of the grip engages the upper horizontal portion of the activation rod 15, the entire rod 15 moves upwardly, thereby causing the lower horizontal portion thereof to engage the bottom of the aerosol gas dispenser 9, thereby moving the aerosol gas dispenser 9 in the upward direction in the view of the figures. When this occurs, the tube 21 remains fixed and the aerosol gas dispenser container moves upwardly with respect thereto to open the valve within the dispenser 9 (not shown) to permit aerosol gas to flow through the nozzle 10, through the transfer tube 11, and into the drying chamber 2, whereupon the aerosol gas envelops the golf club grip and thoroughly dries it.

While all of this is occurring, as the golf club grip 17 moves upwardly in the drying chamber 2, the brushes 3 are provided to properly align the golf club grip within the drying chamber 2 to provide stability as the grip 17 moves upwardly within the chamber 2.

When the aerosol gas dispenser 9 is being installed within the chamber 8, the activation rod 15 is pulled down as seen in FIG. 2 below the level of the door 7 so that the lower horizontal rod may be rotated out of the way of the access opening through the door 7 to permit the aerosol gas dispenser 9 to be inserted within the chamber 8 in the direction of movement shown by the arrow in FIG. 2. When aerosol gas has been dispensed from the dispenser 9 for a desired period of time, the golf club grip 17 is lowered within the chamber 2 to release the lower horizontal portion of the activation rod 15, thereby closing the valve (not shown) within the aerosol gas dispenser, thereby causing cessation of the flow of aerosol gas through the tube 11. The golf club grip may be pulled from the chamber 2 and it is now dried and ready for use.

In one embodiment of the present invention, the cylindrical chamber can be about 14 inches in length with a diameter of about 2 inches. The aerosol gas dispenser chamber 8 may be about 10 inches in length and 2 inches in diameter. The gas dispensed from the aerosol gas dispenser 9 may be of any type such as is well known to those of ordinary skill in the art for use in drying objects by removing moisture therefrom.

As such, an invention has been disclosed in terms of a preferred embodiment thereof which fulfills each and every one of the objects of the invention as set forth hereinabove, and provides a new and useful ultra dry golf club grip dehumidifier system of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A golf club grip dehumidifier, comprising:

a) a first chamber sized to receive therein a golf club grip;

b) a second chamber connected to said first chamber and containing a source of dehumidifying gas; and c) actuator means for actuating flow of dehumidifying gas from said second chamber to said first chamber.

2. The dehumidifier of Claim 1, wherein said first chamber has a bottom opening sized to receive, therethrough, a golf club grip.

3. The dehumidifier of claim 2, wherein said bottom opening is sealed by a collapsible throat.

4. The dehumidifier of claim 3, wherein said collapsible throat is made of rubber.

5. The dehumidifier of claim 1, wherein said second chamber includes a bottom opening closeable by an access door.

6. The dehumidifier of claim 1, wherein said source of dehumidifying gas comprises an aerosol can.

7. The dehumidifier of claim 6, wherein said actuator means opens a valve in said can.

8. The dehumidifier of claim 1, wherein said actuator means comprises a rod having a top end and a bottom end, a first horizontal rod protruding from said top end into said first chamber and a second horizontal rod protruding from said bottom end into said second chamber.

9. The dehumidifier of claim 8, wherein said first chamber has a bottom opening sized to receive, therethrough, a golf club grip.

10. The dehumidifier of claim 9, wherein said rod is biased toward said bottom opening.

11. The dehumidifier of claim 10, wherein said source of dehumidifying gas comprises an aerosol can.

12. The dehumidifier of claim 11, wherein said second horizontal rod engages a bottom surface of said can.

13. The dehumidifier of claim 12, wherein when a golf club grip engages said first horizontal rod, upward movement of said golf club grip moves said rod upwardly, causing said second horizontal rod to move said can upwardly, thereby opening a valve in said can to cause gas to be dispensed therefrom and into said first chamber.

14. A golf club grip dehumidifier, comprising:

a) a first chamber sized to receive therein a golf club grip, said first chamber having a first bottom opening sized to receive, therethrough, a golf club grip, said bottom opening being sealable by a collapsible throat;

b) a second chamber connected to said first chamber and containing a source of dehumidifying gas comprising an aerosol can; and c) actuator means for actuating flow of dehumidifying gas from said second chamber to said first chamber, said actuator means opening a valve in said can.

15. The dehumidifier of claim 14, wherein said collapsible throat is made of rubber.

16. The dehumidifier of claim 14, wherein said second chamber includes a second bottom opening closeable by an access door.

17. The dehumidifier of claim 14, wherein said actuator means comprises a rod having a top end and a bottom end, a first horizontal rod protruding from said top end into said first chamber and a second horizontal rod protruding from said bottom end into said second chamber.

18. The dehumidifier of claim 9, wherein said rod is biased toward said second bottom opening.

19. The dehumidifier of claim 18, wherein said second horizontal rod engages a bottom surface of said can.

20. The dehumidifier of claim 19, wherein when a golf club grip engages said first horizontal rod, upward movement of said golf club grip moves said rod upwardly, causing said second horizontal rod to move said can upwardly, thereby opening said valve in said can to cause gas to be dispensed therefrom and into said first chamber.

* * * * *